United States Patent [19]

Thiele

[11] 4,358,020

[45] Nov. 9, 1982

[54] APPARATUS FOR ALIGNING TROLLEYS

[75] Inventor: Duane L. Thiele, Schofield, Wis.

[73] Assignee: J. I. Case Company, Racine, Wis.

[21] Appl. No.: 221,835

[22] Filed: Dec. 31, 1980

[51] Int. Cl.[3] ..... B66C 5/02

[52] U.S. Cl. ..... 212/147; 212/153; 212/218; 105/163 SK; 414/460

[58] Field of Search ..... 340/685; 414/460, 461; 212/149, 153, 146, 147, 205, 218; 104/98; 294/81 SF, 67 DA; 105/163 R, 163 SK

[56] References Cited

U.S. PATENT DOCUMENTS 3,703,016 11/1972 Schramm ..... 212/149 X 3,826,380 7/1974 Lenander ..... 212/153 X

*Primary Examiner*—Richard A. Schacher

*Attorney, Agent, or Firm*—Dressler, Goldsmith, Shore, Sutker & Milnamow, Ltd.

[57] ABSTRACT

In a crane having two trolleys free to move independently and parallel to each other and supporting a common load, such as a spreader, an apparatus is provided to alert the operator of the crane when the common load is excessively skewed. In one embodiment, a flexible inextensible cable connects the two trolleys together. One end of the cable is joined to one trolley and the other end of the cable is joined to a constant tension spring carried by the other trolley. Once the two trolleys are aligned without the common load being skewed, any relative motion between the two trolleys causes the load to become skewed and a change in relative position of that end of the cable joined to the constant tension spring. A tripping device is positioned adjacent to that end of the cable joined to the constant tension spring. The tripping device actuates an alarm or other suitable circuit to alert the crane operator when the two trolleys are excessively misaligned or when the load carried by the trolleys has been excessively skewed.

18 Claims, 2 Drawing Figures

APPARATUS FOR ALIGNING TROLLEYS

TECHNICAL FIELD

The present invention relates to load-handling apparatus, and more particularly to cranes, such as straddle carriers having two trolleys supporting a common load from a cable system.

BACKGROUND OF THE INVENTION

In recent years the entire transportation and shipping industry has undergone a revolution. In an effort to improve delivery times and reduce costs, the shipping industry has become containerized. Instead of moving goods by handling individual cartons and boxes, the modern approach has been to package boxes and cartons into larger standardized "containers". A whole new class of ship has been developed to handle these containers. The containers are transported or moved from one place to another by a spreader, (i.e. a structural frame that conformably engages and attaches to the container). The spreader itself is supported at each end by a plurality of cable and sheave arrangements for raising and lowering the containers. Containers are usually twenty or thirty feet in length and have specially adapted brackets at the corners to receive latches carried by the spreader to support the containers during transportation.

A straddle carrier is one material handling machine which has been developed to transport containers. A straddle carrier generally consists of an inverted U-shaped frame that has wheels on the lower ends of the respective legs. The legs define an elongated open bay with a spreader unit supported inside the bay. The spreader defines the longitudinal axis of the carrier; the spreader normally has latches at the respective corners thereof for coupling to a container. A hoisting means or crane is then used to raise and lower the spreader.

The cranes that support spreaders conventionally include a bridge structure of spaced horizontal girders. These girders extend transversely between the two legs forming the bay. The bridge structure or girders themselves typically carry one or more sets of trolleys.

Two trolleys are often used to spread apart the suspension cables while it is being raised or lowered and to inhibit and arrest swaying of the load. The "skew" of the spreader is a measure of the annular displacement of the spreader about a vertical axis. Two other measures of the alignment of the spreader are "list" and "trim". List and trim are angular displacements measured about horizontal axes. The list and trim axis are mutually perpendicular to each other and perpendicular to the vertical axis defining the skew of the spreader. Since the spreader is supported by two trolleys and since each trolley is independently suspended or carried by a separate girder on the bridge structure, the spreader will be skewed or rotated about a vertical axis unless the trolleys are displaced equally to one side of a vertical plane passing through the trim axis.

Because of the large size of straddle carriers, it is generally difficult for the crane operator to affect the desired alignment of the cable suspended spreader with the cargo container, particularly when the spreader is relatively distant from that operator. Frequently, an additional workman or assistant is necessary to properly align the spreader. Unless the spreader is properly aligned the crane operator will have difficulty joining the spreader to the container.

Heretofore relatively complicated electromechanical and electrohydraulic devices have been used to synchronize and align the two trolleys relative to one another so as to control the amount of skew. The skew control taught by Smith (U.S. Pat. No. 3,204,577) by White et al. (U.S. Pat. No. 3,656,795) and by S. V. Lynd (U.S. Pat. No. 3,166,023) are typical examples.

It can be appreciated from the description given above that unless the operator of the straddle carrier is given some indication of the amount of skew of the spreader, any attempt to join the spreader with the container has the potential for failure. If the productivity of the crane operator and the efficiency of the crane are to be maximized, the operator must be made aware when the spreader becomes skewed beyond a certain point after which there is a marginal probability that the spreader can be successfully coupled with the container unless the trolleys are aligned.

SUMMARY OF THE INVENTION

The present invention provides an apparatus that warns the crane operator of a container handling apparatus employing two trolleys to suspend a single load, such as the spreader of a straddle carrier, that the load is skewed excessively or the trolleys are excessively misaligned. For purposes of illustration the invention is discussed in relation to a straddle carrier. The straddle carrier has: a bridge structure formed from two longitudinally spaced transversely extending girders or beams, and a trolley supported on each beam suspending one end of a spreader. A flexible, inextensible means, such as a steel cable, is used to laterally join together the two trolleys in such a manner so as to provide a relative indication of the amount of skew on the spreader.

In one specific embodiment, one end of a cable is joined to one of the trolleys and the other end of the cable is joined to a constant tension spring carried by the second trolley. A sheave mounted on the second trolley is used to bend the cable to form two mutually perpendicular legs. When the trolleys are aligned parallel to one another, the sheave and length of the cable are adjusted in such a manner as to align the leg of the cable between the first trolley and the second trolley so that it lies in a vertical plane parallel to the skew axis of the spreader and trim axis of the spreader. When the cable and the sheave are so adjusted, any displacement of the two trolleys from the zero skew position will result in that leg of the cable between the sheave and the constant tension spring decreasing in length. In particular, the amount of skew of the spreader is proportional to the change in length of that leg of the cable.

By connecting a tripping device to the end of the cable joined to the constant tension spring, an electrical circuit can be actuated to warn the operator that the two trolleys and the associated spreader have been displaced relative to one another beyond the set point of the tripping device. When so warned the crane operator can reposition his trolleys to clear the alarm. When so aligned there is a greater likelihood that the spreader will be coupled to the container without difficulty. This, in turn, improves the overall productivity of the machinery operator and the efficient utilization of the straddle carrier.

Numerous other advantages and features of the present invention will become readily apparent from the following detailed description of the invention and of the embodiments illustrated therein, from the claims and from the accompanying drawings.

DETAILED DESCRIPTION

Figure 1:
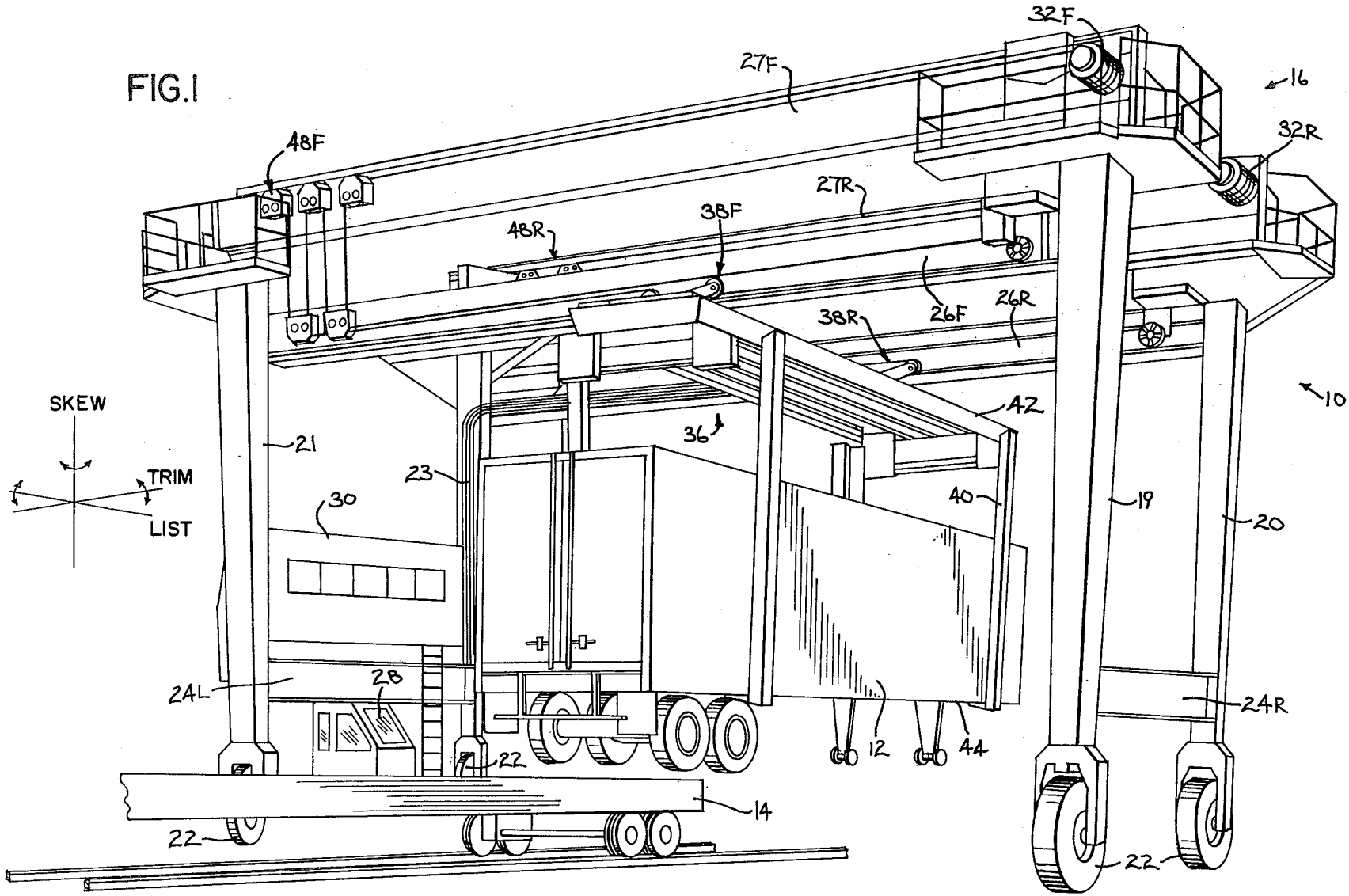
FIG. 1 shows a perspective view of the straddle carrier having the various features of the present invention incorporated therein.

While this invention is susceptible of embodiment in many different forms, there is shown in the drawings, and will herein be described in detail, a specific embodiment with the understanding that the present disclosure is to be considered as an exemplification of the principles of the invention and is not intended to limit the invention to the specific embodiment illustrated.

FIG. 1 is a perspective view of a straddle carrier 10 specifically adapted to be used in transporting a trailer or container 12 to and from a railroad flat car 14. The straddle carrier 10 consists of a generally elongated U-shaped frame having an upper horizontal bridge structure 16 and a pair of spaced legs 19 and 20, 21 and 23 pending from opposite edges of the bridge structure. Each leg 20 is supported at its lower end by a wheel or tire 22. The legs are interconnected at their lower ends by an elongated longitudinal, hollow girder or structural I-beam 24R, 24L and at their upper ends by an elongated, hollow, transversely extending beam 26F and 26R to define the generally inverted U-shaped frame that defines an elongated open cargo receiving bay. A machinery or crane operator's compartment or cab 28 supported by one 24L of the two girders. An engine compartment 20 is also supported by one 24L of the two girders. The engine drives a plurality of pumps for supplying hydraulic fluid to a plurality of motors and hydraulic actuators. The engines also supply power to drive a set of winches 32R and 32F.

The upper ends of the legs 19 and 20, 21 and 23 are joined by two pairs of traversely extending beams or girders: an upper set 27F and 27R and a lower set 26F and 26R. Each lower beam 26F, 26R supports a movable trolley 38R, 38F. Each trolley in turn supports one end of the spreader 36 via a cable reeving system 48F, 48R (not completely shown).

The engine also drives the wheels 22 of the straddle carrier 10. The wheels 22 are steerable to allow a greater degree of freedom of movement. The spreader 36 may be joined to the top or bottom of the container 12. As shown in FIG. 1, the spreader 36 has four downwardly pending arms 40 used to suspend the load 12 at its base 44. The spreader 36 may also be adapted to couple to the container 12 at its upper end.

The winches 32F and 32R power the cable reeving system 48F, 48R to position the trolleys 38F and 38R along two lower traversely extending beams 26R and 26F. The trolleys 38F and 38R are positioned on the lower beams 26R and 26F to accurately align the spreader with the container 12. The winches 32F and 32R are also used to raise and lower the spreader 36.

Figure 2:
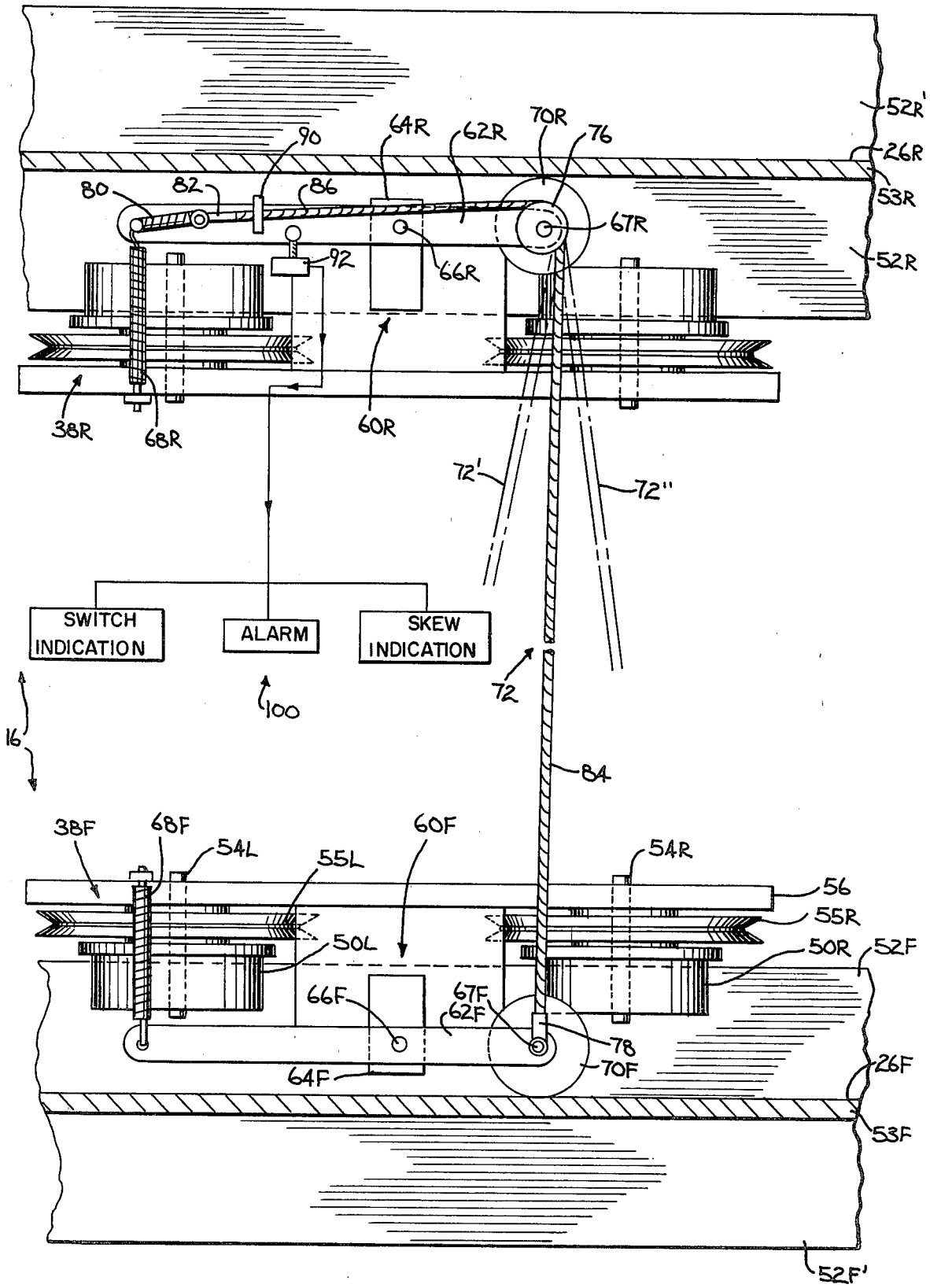
FIG. 2 is a partial, cross sectional plan view of the bridge structure of the straddle carrier shown in FIG. 1 illustrating the relationship between the principal components of the invention.

Referring to FIG. 2, there is illustrated a partial plan view of the two lower beams 26F and 26R and a portion of the front trolley 38F and the rear trolley 38R. Turning to the front trolley 38F, that trolley includes a pair of flanged wheels 50R and 50L (only one wheel of each pair is shown for clarity) which ride along the lower horizontal flange elements 52F and 52F' of the lower beam 26F. Each flanged wheel 50R, 50L is in turn keyed to a shaft or axle 54 which is also keyed to a pulley 55R, 55L. A spacer or frame 56 separates the two axles 54L and 54R on one lower flange element 52F from a corresponding pair of wheels and pulleys on the other lower flange element 52F'. A transverse vertical web 53F, 53R joins the lower horizontal flange elements 52F and 52F', and 52R and 52R' with the upper horizontal flange (not shown) of each lower beam 26F, 26R. Together the wheels, the pulleys and the frames form a truck or carriage upon which the associated trolley 38F moves along the lower beam 26F. A portion of the cable reeving system 48F (See FIG. 1) is reeved over the two pulleys 55L and 55R on the front trolley 38F to move that trolley transversely along the lower beam 26F. A similar set of wheels, pulleys, and frames are used on the rear trolley 38R. For purposes of simplicity and to aid in otherwise understanding the drawings, those components on the rear trolley 38R which are otherwise identical to and which function in the same way as those components on the front trolley 38F, have not been marked or otherwise identified in FIG. 2.

Each trolley 38R, 38F has a web follower 60R, 60F located between the upper flange (not shown) and the two facing lower flange elements 52F and 52R of the two lower beams 26F and 26R. Each web follower 60R, 60F includes a link 62R, 62F pivoted about a vertical axis to a fixed portion 64F, 64R on the trolley 38F, 38R. Each link 62F, 62R is joined to the fixed portion 64F, 64R of the trolley 38F, 38R by a pivot pin 66F, 66R passing through a point intermediate the ends of the link. One end of each link 62F, 62R is joined to a spring 68F, 68R. The other end of that spring 68F, 68R is joined to a fixed portion of the trolley 38F, 38R. As specifically illustrated in FIG. 2, the spring 68F, 68R is joined to the frame 56 joining together the wheels of the trolley. The other end of the link is pinned to a wheel 70F, 70R. Thus, the spring 68F, 68R biases or holds the wheel 70F, 70R against the vertical web 53F, 53R of each lower beam 26F, 26R. Therefore, as the trolley 38F, 38R moves transversely along the lower beam 26F, 26R the wheel 70F, 70R on each follower 60F, 60R rolls along the web 53F, 53R. Since the web 53F, 53R lies in a substantially vertical plane the axle or axis of revolution 67F, 67R of the wheel 70F, 70R defines a substantially vertical axis. This axis is used as a point of reference in determining the relative position of the two trolleys 38F and 38R.

The two followers 60F and 60R are joined together by a flexible inextensible means such as a steel cable 72. One of the followers, here the rear follower 60R, has a sheave 76 coaxially mounted on the same axle 67R upon which the wheel portion 70R of the follower 60R is mounted. One end of the cable 72 is coupled to the axle 67F of the follower 60F not having the sheave, here the front follower 60F. The cable 72 is coupled to that axle 67F by a fitting 78 which allows the cable 72 to freely swing in a generally horizontal plane (i.e. a plane perpendicular to axle of the follower 60F to which it is attached). The opposite end of the cable 72 is reeved over the sheave 76 and then joined to the constant tension spring 80 by a fitting 82. The opposite end of the constant tension spring 80 is joined to that end of the lever 62R to which the follower spring 68 is attached. When so reeved the cable 72 defines two mutually perpendicular legs: a first leg 84 suspended between the two followers 60F and 60R and a second leg 86 lying generally along the longitudinal axis of follower 60R to which the sheeve 76 is mounted.

The two biasing springs 68F and 68R on the two followers 60F and 60R preferably should have a greater spring constant than that of the constant tension spring 80. This insures that the two wheels 70F and 70R of the two followers 60F and 60R are maintained against the vertical web 73F, 73R of the two lower beams 76F and 76R and that any tension in the cable 72 will be taken up by the constant tension spring 80 and will not be used to develop a pivoting force tending to displace the wheels 70F and 70R of the two followers from the vertical webs of the lower beams.

When the two trolleys are aligned generally parallel to each other the spreader 36 will be aligned with zero skew. Since the lower flanges 52F and 52R of the two lower beams 26F and 26R define a substantially horizontal plane, and since the two axles 67F and 67R on the two followers 60F and 60R define two substantially vertical axes, that leg 84 of the cable 72 joining the two trolleys 38F and 38R will for all practical purposes define the shortest distance between the two axles 67F and 67R of the two trolleys. Moreover, that leg 84 of the cable 72 joining the two trolleys 38F and 38R will lie in a vertical plane substantially parallel to a vertical plane passing through the skew axis of the spreader and the list axis of the spreader 36. Furthermore, since the constant tension spring 80 maintains the same tension in the cable 72 regardless of the amount of stretch or extension of the constant tension spring 80, any relative movement between the two trolleys 38F and 38R along the lower beams 26F and 26R from the aligned or zero skew position changes the relative lengths of the two legs 84 and 86 of the cable 72.

In FIG. 2 there is shown in phantom the displacement of the cable 72 resulting from the front trolley 38F moving to the right (cable 72'') or to the left (cable 72') of the rear trolley 38R. In each case when the front trolley 38F moves to the right or to the left of the rear trolley 38R, the length of the leg 84 joining the two trolleys increases while the length of the leg 86 joined to the constant tension spring 80 decreases in length. Therefore, since the transverse displacement of one trolley relative to another produces a skewed condition in the spreader 36, the change in length of the leg 86 of the cable 72 joined to the constant tension spring 80 is effectively a "measure" of the amount of skew of the spreader. This relationship between the change in the relative lengths of the two legs 84 and 86 of the cable 72 can be used: (1) to measure the relative amount of skew of the spreader 36; (2) to provide an indication or warning that the spreader has been skewed or displaced beyond a predefined allowable maximum; and (3) as an error signal input to a trolley positioning mechanism to automatically align the trolleys after they have been repositioned.

To provide a warning to the operator of the straddle carrier 10 that the spreader 36 has been skewed beyond a predefined limit, or that the trolleys are "excessively misaligned", the cable 72 is used to trip a switch actuated alarm or actuate a suitable electrical circuit 100. Specifically, a trip bar 90 and a limit switch 92 are used. The trip 90 bar is connected to that leg 86 of the cable 72 joined to the constant tension spring 80. A limit switch 92 is attached to a fixed portion of the follower 60R on the trolley 38R carrying the constant tension spring 80 in such a position that it can be actuated by the trip bar 90. The trip bar 90 has other uses.

Since the change in length of that leg 86 of the cable 72 joined to the constant tension spring 80 is proportional to the amount of skew of the spreader 36 resulting from the relative misalignment of the two trolleys 38R and 38F, the displacement of the trip bar 90 from its position where the spreader 36 is not skewed can also be used to provide an input to an electrical circuit having a proximity detector sensor in place of or in addition to the switch 92, which can be calibrated to produce a output that continously provides the crane operator an indication of the skew on the spreader. It can also be used as an error signal to drive an automatic trolley alignment mechanism.

The position of the limit switch 92 relative to the trip bar 90 or the "setpoint" of the limit switch is determined by the design of the spreader 36 (i.e. that degree or amount of skew beyond which it has been found that coupling of the spreader to the container is not likely to occur). In other words, with the two trolleys 38R and 38F aligned parallel to one another and with the spreader 36 aligned with zero skew on the spreader 36, one trolley is moved or displaced relative to the other until that amount of skew (a so called "pre-selected" degree of skew) is produced which is to be equal to the trip point of the alarm. When so displaced the trip bar 90 is positioned to actuate the limit switch 92. Therefore, the limit switch 92 is positioned in relationship to the trip bar 90 so that the limit switch is tripped if the load or spreader 36 is skewed by an amount at least equal to the pre-selected degree of skew. Any displacement of the two trolleys 38F and 38R tending to bring them into alignment and to position where the spreader 36 is in a zero skew condition will result in the trip bar 90 moving away from the limit switch 92 in the direction of the constant tension spring 80.

Although FIG. 2 shows only one limit switch 92 present, a plurality of limit switches can be so located to provide a series of alarm set points such as when the spreader 36 has been skewed to say, five degrees and then skewed to say, ten degrees. Similarly, another limit switch can be positioned in such a manner that is actuated whenever the trip bar 90 is in the zero skew position. This would provide the straddle carrier operator or crane operator with a positive indication that the spreader 36 has been properly aligned with zero skew.

In one specific embodiment where the vertical webs 53F and 53R are separated by a distance of approximately 19 feet, where a $\frac{1}{8}$ inch wire rope is used for the cable 72, and where an eight inch diameter sheave 76 was used, a skew of five degrees at the spreader 36 resulted in that leg 86 of the cable joined to the constant tension spring 80 changing length by approximately $\frac{3}{4}$ of an inch.

It should be understood that the principle of the invention is independent of the particular arrangement of the two followers 60F and 60R. Moreover, it is not necessary that the two transverse beams 26F and 26R supporting the trolleys 38R, 38F define a substantially horizontal plane. All that is necessary is that with the two trolleys aligned (i.e. zero skew on the spreader 36), the sheave 76 be positioned in such a manner that the leg 84 of the cable 72 spanning between the two trolleys 38R and 38F lies in generally vertical plane. This latter requirement is equivalent to the statement that with the trolleys aligned, the sheave 76 should be positioned in such a manner that the leg 84 of the cable 72 joining the two trolleys 38R and 38F defines the shortest straight line distance between one end of the cable and that part of the cable tangent to the sheave. Any other position of the trolleys will define a leg 84 longer in length.

Similarly, the principle of the invention applies if the cable 72 is reeved around the sheave 76 so that the two ends of the cable are carried by the same trolley. Since the cable 72 will have some "stretch" any error in aligning the two trolleys will be minimized if the total cable length is kept as short as possible. For that matter the cable 72 could be replaced by a rigid link pivoted at one end to one of the trolleys and joined to the constant tension spring 80 or the other trolley. Moreover, since the spring 80 changes in length to maintain the same tension in the cable 72 whenever the trolleys move relative to each other, the "stretch" of the spring from a reference length is a measure of the skew. Consequently, the two trolleys are aligned whenever the spring has a length equal to the reference length.

It should be noted that the sheave 76 will have a tendency to "take up" a portion of the tension in the cable 72 due to frictional coupling between the cable and the periphery of the sheave. A ninety degree change in direction of the cable 72 produces the least coupling with the greatest change in direction. Under this arrangement the change in the position of the other end 82 of the cable 72 is due to the angular displacement of the trolleys and not due to the angular displacement of constant tension spring 80. In other words, if the constant tension spring 80 is kept from pivoting when the trolleys change their relative position, a greater change in position of other end 82 of the cable is produced for any given trolley misalignment.

Finally, it should be understood from the foregoing that if the trolleys are "closely coupled" to their supports (in the sense that the trolleys do not contribute significantly to a change in cable length due to their lateral displacement along the path of travel), then the trolley followers are not needed. However, this is not the usual case in ordinary installations since the wheels on the trolley are flanged to the support beam. If insufficient lateral clearance is provided between the wheels 50R, 50L and the support beam 53F, 53R, the trolleys will "bind up" or derail. Consequently, a practical installation will ordinarily incorporate one or more trolley followers. In the last analysis this decision is a matter of design that is within the capability of one of ordinary skill in the art.

Thus, it is apparent that there has been provided in accordance with this invention a novel device that responds to skew of a spreader suspended from two trolleys and warns the crane operator when the trolleys are excessively misaligned. While the invention has been described with respect to a specific embodiment, it should be appreciated that the principles of the invention would also apply if the two trolleys moved vertically relative to one another. The reference surface on which the followers were seen to ride need not be perfectly vertical and the two trolleys need not travel at the same vertical elevation. Once the basic principle of the invention is understood it will be realized that there are many alternatives, modifications and variations that will be apparent to those skilled in the art in light of the foregoing description. Accordingly, it is intended to cover all alternatives, modifications, and variations as set forth within the spirit and broad scope of the following claims.

What is claimed is as follows:

1. In a straddle carrier having: an inverted U-shaped frame defining a container carrying bay between first and second legs; first and second longitudinally spaced transversely extending beams supported by said frame; a first and second trolley carried by said first and second beams respectively, each trolley being free to move transversely relative to said bay along said beams, each of said beams defining a substantially vertical surface parallel to the path traversed by said trolleys on said beams; and a spreader supported by said trolleys and used to connect containers thereto, apparatus for signalling that said spreader is skewed beyond a first preselected angle, comprising:

(a) first and second trolley followers on said first and second trolleys respectively, each of said trolley followers including:

a link pivotally connected to the trolley at a point intermediate the ends of said link, said link freely pivoting about an axis generally perpendicular to the plane of travel of the trolley on its beam;

a reference wheel, the axle of which is journaled to one end of said link and is parallel to the pivot axis of said link; and biasing means, joining the opposite end of said link and a fixed point on the trolley, for holding the periphery of said reference wheel against said vertical surface on said beam, the axis of said reference wheel remaining at a substantially fixed distance from said vertical surface while said trolley is repositioned along said beam.

said first and second trolley followers when positioned with the axes of said reference wheels lying in a vertical plane substantially perpendicular to said vertical surfaces then defining the "zero skew positions" of said trolleys and the spreader carried by said trolleys, the angular skew of said trolleys being defined as the acute angle between the vertical plane established by the axes of said reference wheels and the plane established by the axes of said reference wheels with said trolleys in a zero skew position;

(b) a sheave free to rotate about the axis of said reference wheel on the second trolley follower;

(c) flexible inextensible means, connected at one end to the first trolley follower and connected at the other end to a constant tension spring which is connected at its opposite end to the opposite end of the link on the second trolley follower, said inextensible means being reeved over said sheave on the second trolley follower, the position of said other end of said inextensible means relative to said opposite end of said link on said second trolley follower when said trolleys are in a zero skew position defines the "reference position" of said one end of said inextensible means, relative movement of said trolleys along said beams from a zero skew position to a skewed position driving said other end of said inextensible means away from said reference position, said trolleys being aligned relative to one another by repositioning the trolleys until said other end of said inextensible means returns to said reference position; and (d) trip means, carried by the other end of said inextensible means, for tripping a switch carried by said second trolley in response to said other end of said inextensible means being driven from said reference position to a first position, said trolleys when displaced from said zero skew position to the extent of skewing said spreader to a first pre-selected angle defining the "first position" of said other end of said inextensible means relative to said opposite end of said link on said second trolley follower, whereby the tripping of said switch signals that said spreader is skewed to an angle at least equal to said first pre-selected angle.

2. The straddle carrier as set forth in claim 1, further including: warning means, actuated by said trip means, for alerting the operator positioning said trolleys on said beams to the fact that said trolleys are misaligned to said first skewed position.

3. Apparatus, suitable for use on a crane having two trolleys, for indicating that a load suspended by two trolleys is skewed beyond a pre-selected angle of skew, said trolleys traveling parallel to each other along a pair of spaced transversely extending supports with one of said supports defining a reference surface aligned generally normal to the plane defined by the paths of travel of said trolleys, comprising:

(a) first trolley follower means, carried by that trolley on said one support and cooperating with said reference surface, for establishing an axis generally parallel to the paths of travel of said trolleys, said axis and a reference point on the other trolley defining a plane, said trolleys when positioned with said axis and said reference point defining a plane substantially perpendicular to said reference surface establishing the "zero skew positions" of said trolleys;

(b) inextensible means, connected at one end to said reference point on said other trolley, for flexibly joining together said trolleys;

(c) extensible means, carried by that trolley on said one support, for applying constant tension to the other end of said inextensible means, the position of said other end of said inextensible means relative to a fixed point on said first trolley follower means when said trolleys are in a zero skew position defining the "reference position" of said other end of said inextensible means, whereby any relative displacement of said trolleys from a zero skew position to a skewed position forces said other end of said inextensible means away from said reference position and towards said one end of said inextensible means, said trolleys being aligned relative to one another by repositioning said trolleys until said other end of said inextensible means is in said reference position;

(d) a switch; and (e) trip means, carried by said inextensible means, for actuating said switch in response to said other end of said inextensible means moving from said reference position to a first position and for de-actuating said switch in response to said other end of said inextensible means moving from said first position to said reference position, said trolleys when positioned to skew said load by an amount equal to said pre-selected angle of skew defining the "first position" of said other end of said inextensible means relative to said reference position, the position of said switch being an indication of the skewed condition of the load suspended by said trolleys.

4. The apparatus defined in claim 3, further including a sheave carried by that trolley on said one support, said inextensible means being reeved over said sheave, said sheave being positioned relative to the trolley carrying said sheave such that the portion of said inextensible means between said other trolley and said sheave forms a generally right angle relative to that portion of said inextensible means between said sheave and said extensible means.

5. Apparatus for warning that two trolleys of a crane under the control of an operator are misaligned relative to each other, said trolleys traveling parallel to one another and carrying a common load, one of said trolleys defining a reference axis perpendicular to the plane established by the parallel paths of travel of said trolleys, comprising:

(a) flexible inextensible means, pivotally connected at one end to a reference point on the other trolley, for flexibly joining said trolleys;

(b) tensioning means, carried by said one trolley, for applying constant tension to the other end of said inextensible means, said reference axis on said one trolley and the reference point established on the other trolley establishing a plane, said trolleys when positioned so that said plane is substantially perpendicular to the paths of travel of said trolleys defining the "zero skew positions" of said trolleys, said trolleys in said zero skew positions defining the "reference position" of said other end of said inextensible means whereby any relative displacement of said trolleys from a zero skew position to a skewed position forces said other end of said inextensible means away from said reference position, said trolleys being aligned whenever said other end of said inextensible means is in said reference position;

(c) an alarm; and (d) actuating means, joined to said other end of said inextensible means, for actuating said alarm in response to said other end of said inextensible means moving from said reference position to a first position, said trolleys when misaligned relative to one another to the extent of imposing a pre-selected skewed condition on said load defining the "first position" of said other end of said inextensible means, whereby the operator controlling the position of said trolleys is alerted to the fact that said trolleys have been misaligned from a zero skewed position to the extent of imposing a skewed condition on said load by an amount at least as great as that skew resulting when said other end of said inextensible means moves from said reference position to said first position.

6. The apparatus as set forth in claim 5, further including a sheave free to rotate about said reference axis defined by said one trolley, said flexible inextensible means being reeved over said sheave.

7. The apparatus as set forth in claim 5, further including: first trolley follower means, carried by said one trolley, for establishing said reference axis.

8. The apparatus as set forth in claim 7, wherein said one trolley is carried by a support defining a reference surface generally normal to the plane defined by the parallel paths of travel of said trolleys, said first trolley follower means cooperating with said surface to establish said reference axis.

9. The apparatus as set forth in claim 8, wherein said first trolley follower means includes:

(a) a link pivotally connected to said one trolley at a point intermediate the ends of said link, said link freely pivoting about an axis parallel to said reference surface;

(b) a reference wheel, the axle of which is journaled to one end of said link about an axis parallel to the pivot axis of said link; and (c) biasing means, joining said link and said one trolley, for holding the periphery of said reference wheel against said reference surface, whereby the axis defined by the axle of said reference wheel remains at a substantially fixed distance from said reference surface while said trolley is repositioned parallel to said reference surface on said beam, the axis of said axle defining said reference axis.

10. The apparatus as set forth in claim 9, further including means, carried by said one trolley, for measuring and displaying the position of said actuating means relative to a fixed point on said one trolley thereby providing continuous indication of the relative amount of skew of said spreader.

11. The apparatus as set forth in claim 3 or 5, further including: second trolley follower means carried by that trolley not carrying said first trolley follower means, said reference point being located on said second trolley follower means.

12. Apparatus for energizing an alarm to warn that two transversely spaced trolleys on a crane are misaligned, said trolleys being constrained to travel parallel to one another while suspending a common load, comprising:

(a) uniformly extensible linking means for transversely linking together said trolleys, said linking means including an inextensible link and uniformly extensible tensioning means, connected to said inextensible link, for applying constant tension on said inextensible link, said inextensible link defining a reference point whose position is measured relative to a fixed point on one of said trolleys, said trolleys defining a first misaligned condition when a pre-selected degree of skew is imposed on said load and said reference point is in a second position relative to said fixed point, said trolleys defining an aligned condition when the skew on said trolleys is less than said pre-selected degree of skew and said reference point is in a first position relative to said fixed point;

(b) a switch, disposed along said linking means and fixed relative to said one trolley, for energizing said alarm, said switch having an open and a closed position, tripping said switch from one of said open and closed positions to the other position has the effect of energizing said alarm; and (c) trip means, carried by said linking means, for tripping said switch from one of its positions to the other in response to said reference point moving from said first position to said second position, whereby said trolleys are aligned relative to each other when said trip means is in said first position and said alarm is de-energized, said switch being tripped and said alarm being energized to warn the crane operator that said load is skewed by an amount at least as much as said pre-selected degree of skew when said trolleys are misaligned relative to each other to the extent of imposing a skewed condition on said load in excess of said pre-selected degree of skew, said switch being repositioned and said alarm being de-energized when said reference point is returned to its first position.

13. The apparatus as set forth in claim 12, wherein the inextensible link includes a flexible inextensible cable.

14. The apparatus as set forth in claim 13, further including a sheave carried by one of said trolleys, said flexible inextensible cable being reeved over said sheave, said sheave dividing said cable into two legs at least one of which is traversely disposed to said trolleys.

15. The apparatus as set forth in claim 12, wherein the tensioning means includes a constant tension spring.

16. The apparatus as set forth in claim 14, further including trolley follower means, carried by said one trolley, for carrying said sheave about a reference axis generally normal to the plane defined by the two parallel paths traversed by said trolleys.

17. The apparatus as set forth in claim 16, wherein said crane defines a reference surface generally normal to the plane defined by the two parallel paths traversed by said trolleys, said trolley follower means riding on said surface to establish said reference axis.

18. The apparatus as set forth in claim 17, wherein said trolley follower means includes:

(a) a link pivotally connected to said one trolley at a point intermediate the ends of said link, said link freely pivoting about an axis parallel to said reference surface;

(b) a reference wheel, the axle of which is journalled to one end of said link about an axis generally parallel to the pivot axis of said link; and (c) biasing means, positioned between said link and said one trolley, for holding the periphery of said reference wheel against said reference surface, whereby the axis defined by the axle of said reference wheel remains at a substantially fixed distance from said reference surface while said trolley is repositioned relative to said reference surface, the axis of said axle defining said reference axis and the axis of rotation of said sheave.

* * * * *